US009239181B2

(12) United States Patent
Son et al.

(10) Patent No.: US 9,239,181 B2
(45) Date of Patent: Jan. 19, 2016

(54) REFRIGERATOR WITH ICE MAKER IN FREEZING COMPARTMENT AND TRANSFER DEVICE TO ICE BANK IN REFRIGERATING COMPARTMENT

(75) Inventors: Juhyun Son, Gyeongsangnam-do (KR); Wookyong Lee, Gyeongsangnam-do (KR); Donghoon Lee, Gyeongsangnam-do (KR); Dongjeong Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 495 days.

(21) Appl. No.: 13/606,769

(22) Filed: Sep. 7, 2012

(65) Prior Publication Data

US 2013/0061626 A1 Mar. 14, 2013

(30) Foreign Application Priority Data

Sep. 9, 2011 (KR) ..... 10-2011-0091800

(51) Int. Cl.

| | |
|---|---|
| ***F25C 5/18*** | (2006.01) |
| ***F25C 1/00*** | (2006.01) |
| ***F25C 1/22*** | (2006.01) |
| ***F25D 25/00*** | (2006.01) |
| ***F25D 3/02*** | (2006.01) |
| ***F25C 5/00*** | (2006.01) |
| *F25D 17/06* | (2006.01) |

(52) U.S. Cl.

CPC ..... *F25C 5/005* (2013.01); *F25C 5/187* (2013.01); *F25D 17/065* (2013.01); *F25D 2317/067* (2013.01)

(58) Field of Classification Search

CPC ..... F25C 1/10; F25C 2305/022; F25C 5/005; F25C 5/187; F25D 2317/067; F25D 17/065

USPC ..... 62/344, 66, 340, 378, 381, 420, 418

See application file for complete search history.

(56) References Cited

U.S. PATENT DOCUMENTS

| | | | | |
|---|---|---|---|---|
| 3,254,505 | A * | 6/1966 | De Turk | 62/353 |
| 3,747,810 | A | 7/1973 | Graser | |
| 5,211,462 | A | 5/1993 | Bien | |
| 6,167,711 | B1 * | 1/2001 | Slattery et al. | 62/78 |
| 6,351,958 | B1 | 3/2002 | Pastryk | |
| 7,392,665 | B2 * | 7/2008 | Lee et al. | 62/353 |

(Continued)

FOREIGN PATENT DOCUMENTS

| | | | |
|---|---|---|---|
| JP | 60-99976 | A | 6/1985 |
| JP | S 61-122468 | A | 6/1986 |

(Continued)

*Primary Examiner* — Cassey D Bauer
*Assistant Examiner* — Joseph Trpisovsky
(74) *Attorney, Agent, or Firm* — Fish & Richardson P.C.

(57) ABSTRACT

A refrigerator includes a cabinet including a refrigerating compartment and a freezing compartment, a refrigerating compartment door opening or closing the refrigerating compartment, a dispenser disposed in the refrigerating compartment door to dispense water or ice pieces, and an ice bank disposed in the refrigerating compartment door to define an insulation space for storing the ice pieces dispensed by the dispenser. The refrigerator also includes an ice maker disposed in the freezing compartment to make the ice pieces, a transfer device disposed in the freezing compartment to transfer the ice pieces supplied from the ice maker into the ice bank, and an ice chute connecting the transfer device to the ice bank.

18 Claims, 11 Drawing Sheets

(56) References Cited

U.S. PATENT DOCUMENTS

| | | | | |
|---|---|---|---|---|
| 2004/0099004 | A1* | 5/2004 | Somura | 62/347 |
| 2006/0260333 | A1 | 11/2006 | Wetekamp | |
| 2006/0260351 | A1 | 11/2006 | Coulter | |
| 2006/0283202 | A1* | 12/2006 | Oh et al. | 62/344 |
| 2008/0134710 | A1* | 6/2008 | An et al. | 62/344 |
| 2009/0145158 | A1 | 6/2009 | Anselmino | |
| 2009/0241583 | A1* | 10/2009 | Cathey et al. | 62/375 |
| 2010/0139299 | A1* | 6/2010 | Lee et al. | 62/137 |
| 2010/0218524 | A1 | 9/2010 | Saito | |
| 2012/0023999 | A1 | 2/2012 | Oh | |
| 2012/0024001 | A1 | 2/2012 | Oh | |

FOREIGN PATENT DOCUMENTS

| | | | |
|---|---|---|---|
| JP | 64-8182 | A | 1/1989 |
| JP | H 02-176380 | A | 7/1990 |
| JP | 03-225169 | A | 10/1991 |
| JP | 09-178317 | A | 7/1997 |
| JP | 47-26159 | A | 11/1997 |
| JP | H 11-142035 | A | 5/1999 |
| JP | 2004-354037 | A | 12/2004 |
| JP | 2010-112676 | A | 5/2010 |
| KR | 10-0765196 | B1 | 10/2007 |
| KR | 10-2011-0037609 | A | 4/2011 |

* cited by examiner

REFRIGERATOR WITH ICE MAKER IN FREEZING COMPARTMENT AND TRANSFER DEVICE TO ICE BANK IN REFRIGERATING COMPARTMENT

CROSS-REFERENCE TO RELATED APPLICATIONS

The present application claims priority under 35 U.S.C. 119 and 35 U.S.C. 365 to Korean Patent Application No. 10-2011-0091800 filed Sep. 9, 2011, which is hereby incorporated by reference in its entirety.

FIELD

This disclosure relates to refrigerator technology.

BACKGROUND

In general, refrigerators are home appliances for storing foods at a low temperature in an inner storage space covered by a door. That is, since such a refrigerator cools the inside of a storage space using cool air generated by heat-exchanging with a refrigerant circulating a refrigeration cycle, foods stored in the storage space may be stored in an optimum state.

Also, an ice maker for making ice pieces may be provided inside the refrigerator. The ice maker is configured so that water supplied from a water supply source or a water tank is received into an ice tray to make ice pieces.

Also, a dispenser for dispensing purified water or ice pieces made in the ice maker to the outside may be provided in the refrigerating compartment door.

SUMMARY

In one aspect, a refrigerator includes a cabinet comprising a refrigerating compartment and a freezing compartment and a refrigerating compartment door configured to open and close at least a portion of the refrigerating compartment. The refrigerator also includes a dispenser disposed at the refrigerating compartment door and configured to dispense ice pieces and an ice bank that is disposed at the refrigerating compartment door, that defines an insulation space for storing the ice pieces, and that is configured to supply the ice pieces to the dispenser. The refrigerator further includes an ice maker disposed in the freezing compartment and configured to make the ice pieces, a transfer device disposed in the freezing compartment and configured to transfer the ice pieces made by the ice maker to the ice bank, and an ice chute that connects the transfer device to the ice bank and that is configured to guide the ice pieces transferred by the transfer device to the ice bank.

Implementations may include one or more of the following features. For example, the transfer device may include a housing configured to store the ice pieces made by the ice maker, a transfer member rotatably mounted inside the housing and configured to transfer the ice pieces within the housing, and a driving motor connected to a rotation shaft of the transfer member and configured to rotate the transfer member. In this example, the transfer member may include a plurality of impellers extending in a radial direction, and the ice pieces may be received into spaces defined by adjacent impellers. Further, a deceleration gear may be connected to a rotation shaft of the driving motor and configured to control a rotation rate of the transfer member.

In some implementations, the ice maker may include an upper tray having a plurality of first recess parts, each having a hemispherical shape, and a lower tray rotatably coupled to the upper tray. In these implementations, the lower tray may have a plurality of second recess parts, each having a shape corresponding to that of each of the first recess parts. In addition, the lower tray may be configured to cause the first and second recess parts to attach to each other to define a spherical shell.

In some examples, the ice chute may extend along sidewalls of the freezing compartment and the refrigerating compartment. In these examples, in a state where the refrigerating compartment door is closed, an outlet end of the ice chute may communicate with the ice bank. In a state where the refrigerating compartment door is open, the outlet end of the ice chute may be disconnected from the ice bank.

The refrigerator may include a cool air duct that extends along sidewalls of the freezing compartment and the refrigerating compartment and that connects the freezing compartment to the ice bank. An inlet end of the cool air duct may communicate with the freezing compartment or an evaporation chamber. An outlet end of the cool air duct may communicate with the ice bank in a state where the refrigerating compartment door is closed and the outlet end of the cool air duct may be disconnected from the ice bank in a state where the refrigerating compartment door is open. In addition, a blow fan may be provided on an inlet-side of the cool air duct.

Further, the refrigerator may include a full ice detection device mounted on at least one of the ice bank and the housing. The refrigerator also may include a vibration generation device configured to transmit vibration to the ice chute to reduce a likelihood of ice pieces within the ice chute adhering to each other.

In some examples, the ice chute may include a first chute extending from the housing and a second chute connected to an end of the first chute and extending along a wall of the refrigerating compartment. In these examples, the end of the first chute may be connected to a position of the second chute that is spaced upward from a lower end of the second chute. Further, in these examples, the transfer device may include a discharge unit configured to push ice pieces within the second chute toward the ice bank.

In some implementations, the discharge unit may include a driving member configured to provide a rotation power, a rotatable reel member connected to the driving member, a discharge member disposed within the second chute, and a wire member having a first end connected to the reel member and a second end connected to a position of the second chute by passing through the discharge member. In these implementations, the wire member may be wound around the reel member when the reel member is rotated to lift the discharge member upward through the second chute, thereby pushing the ice pieces within the second chute toward the ice bank.

The ice chute may return cool air supplied into the ice bank to the freezing compartment. The dispenser may be disposed in the refrigerating compartment door and the ice bank may be disposed in the refrigerating compartment door.

In some examples, the refrigerator may include a door sensor configured to detect opening or closing of the refrigerating compartment door. In these examples, an operation of the transfer device may be restricted according to the opening or closing of the door detected by the door sensor. Also, in these examples, the transfer device may be disabled based on the door sensor detecting opening of the refrigerating compartment door.

The details of one or more implementations are set forth in the accompanying drawings and the description below. Other features will be apparent from the description and drawings, and from the claims.

DETAILED DESCRIPTION

Figure 1:
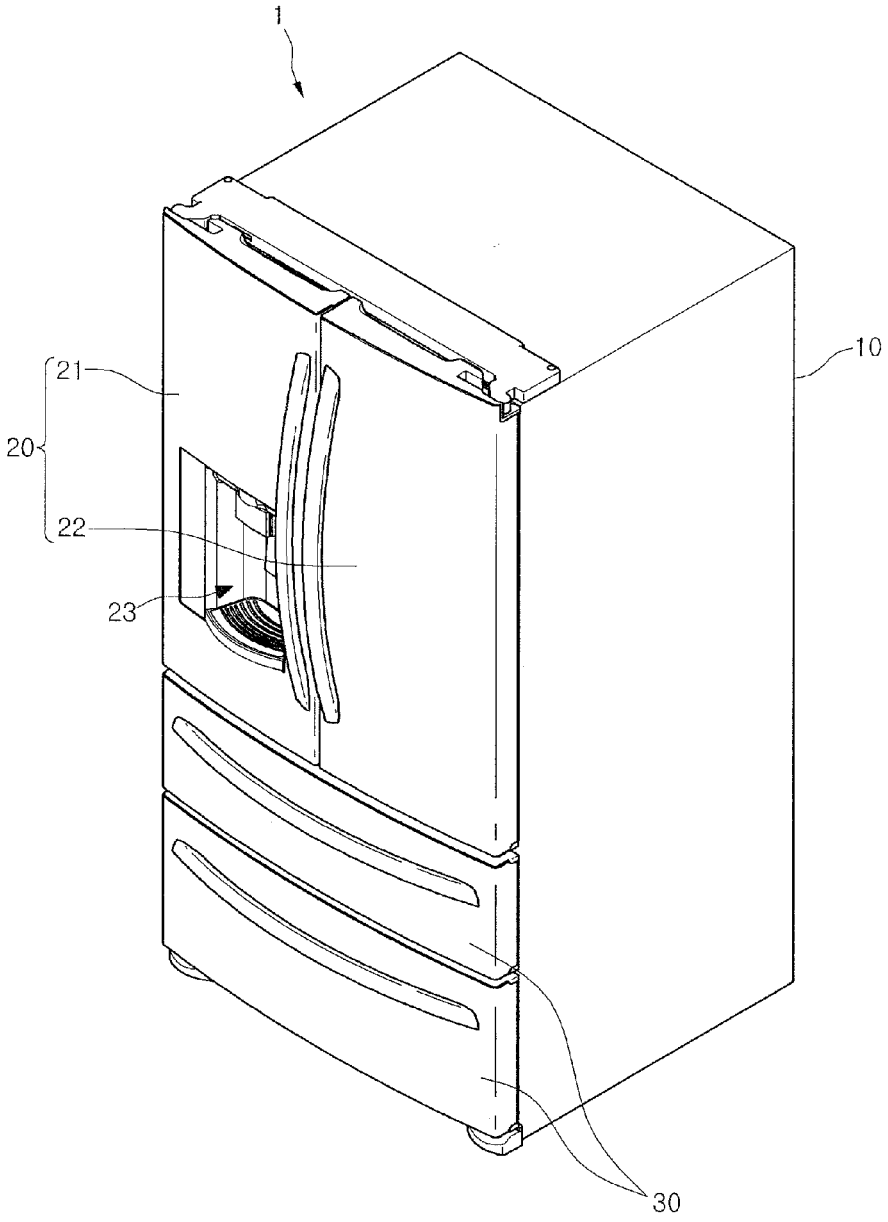
FIG. 1 is a perspective view of a refrigerator.
Figure 2:
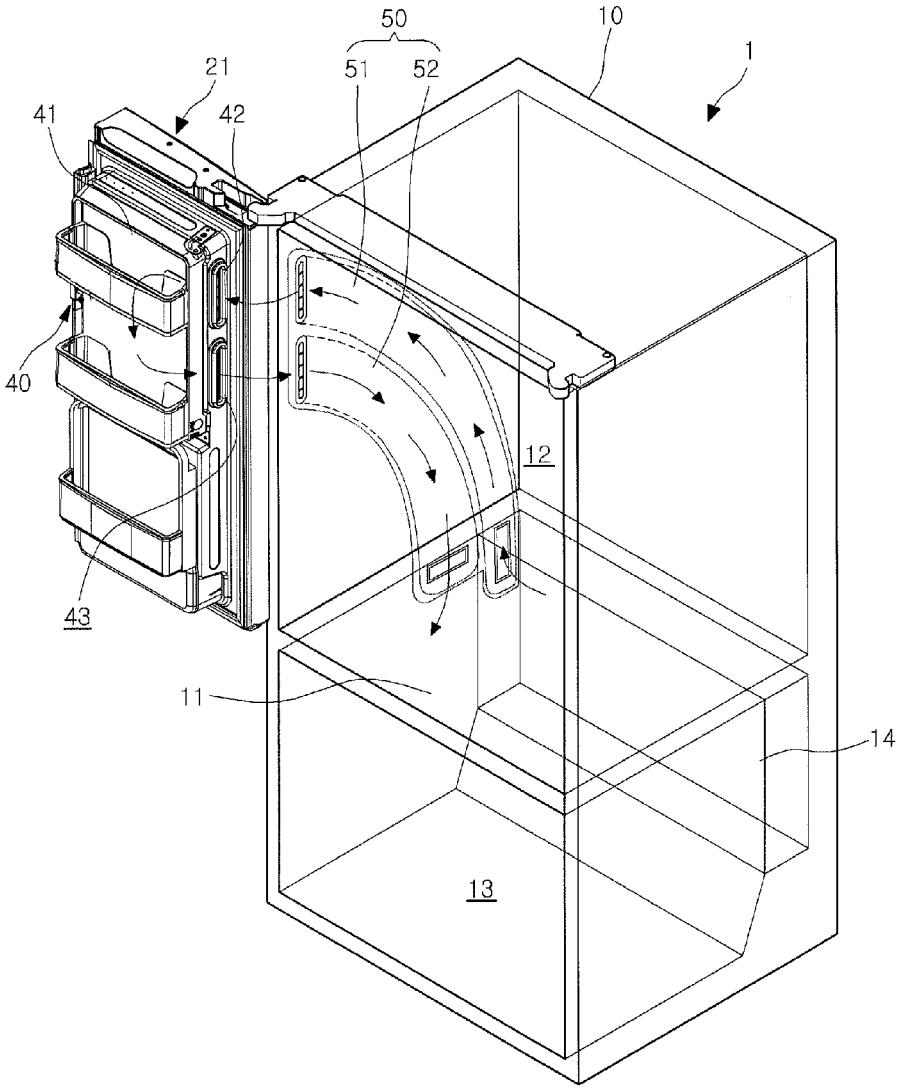
FIG. 2 is a perspective view illustrating a cool air circulation state within the inside of the refrigerator and an ice making compartment.

FIG. 1 illustrates an example refrigerator, and FIG. 2 illustrates a cool air circulation state within an inside of the example refrigerator and an example ice making compartment.

Referring to FIGS. 1 and 2, a refrigerator 1 includes a cabinet 10 defining a storage space and doors 20 and 30 openably mounted on the cabinet 10. Here, an outer appearance of the refrigerator 1 may be defined by the cabinet 10 and the doors 20 and 30.

The storage space within the cabinet 10 is vertically partitioned by a barrier 11. A refrigerating compartment 12 is defined in the partitioned upper side, and a freezing compartment 13 is defined in the partitioned lower side.

The doors 20 and 30 include a refrigerating compartment door 20 for opening or closing the refrigerating compartment 12 and a freezing compartment door 30 for opening or closing the freezing compartment 13. Also, the refrigerating compartment door 20 includes a plurality of doors on left and right sides thereof. The plurality of doors include a first refrigerating compartment door 21, and a second refrigerating compartment door 22 disposed at a right side of the first refrigerating compartment door 21. The first refrigerating compartment door 21 and the second refrigerating compartment door 22 are independently rotated with respect to each other.

The freezing compartment door 30 may be provided as a slidably withdrawable door. The freezing compartment door 30 includes a plurality of vertically disposed doors. The freezing compartment door 30 may be provided as one door as desired.

A dispenser 23 for dispensing water or ice pieces is disposed in one of the first refrigerating compartment door 21 and the second refrigerating compartment door 22. For example, a structure in which the dispenser 23 is disposed in the first refrigerating compartment door 21 is illustrated in FIG. 1.

An ice making compartment 40 for making and storing ice pieces is defined in the first refrigerating compartment door 21. The ice making compartment 40 is provided as an independent insulation space. The ice making compartment 40 may be opened or closed by an ice making compartment door 41. An ice maker for making ice pieces may be provided within the ice making compartment 40. Also, components for storing made ice pieces and dispensing the ice pieces through the dispenser 23 may be provided in the ice making compartment 40.

A cool air inlet 42 and a cool air outlet 43 which communicate with a cool air duct 50 disposed in the cabinet 10 when the first refrigerating compartment door 21 is closed are provided in one surface of the ice making compartment 40. Cool air introduced into the cool air inlet 42 cools the inside of the ice making compartment 40 to make ice pieces. Then, the heat-exchanged cool air is discharged to the outside of the ice making compartment 40 through the cool air outlet 43.

A heat exchange chamber 14 partitioned from the freezing compartment 13 is defined in a rear side of the freezing compartment 13. An evaporator is provided in the heat exchange chamber 14. Cool air generated in the evaporator may be supplied into the freezing compartment 13, the refrigerating compartment 12, and the ice making compartment 40 to cool the inside of each of the freezing compartment 13, the refrigerating compartment 12, and the ice making compartment 40.

Also, the cool air duct 50 for supplying cool air into the ice making compartment 40 and recovering the cool air from the ice making compartment 40 is disposed in a side wall of the cabinet 10. The cool air duct 50 extends from a side of the freezing compartment 13 to an upper portion of the refrigerating compartment 12. When the first refrigerating compartment door 21 is closed, the cool air duct 50 communicates with the cool air inlet 42 and the cool air outlet 43. Also, the cool air duct 50 communicates with the heat exchange chamber 14 and the freezing compartment 13.

Thus, cool air within the heat exchange chamber 14 is introduced into the ice making compartment 40 through a supply passage 51 of the cool air duct 50. Also, cool air within the ice making compartment 40 is recovered into the freezing compartment 13 through a recovery passage 52 of the cool air duct 50. Also, ice pieces are made and stored within the ice making compartment 40 by continuous circulation of the cool air through the cool air duct 50.

In the refrigerator having the above-described structure, making and storage of ice pieces are performed within the ice making compartment 40 provided in the refrigerating compartment 12 to increase a volume of the refrigerating compartment door 20. Thus, a receiving space defined in a back surface of the refrigerating compartment door 20 may be reduced.

Also, cool air for making ice pieces may need to be supplied up to the ice making compartment. Thus, power consumption may be increased.

Figure 3:
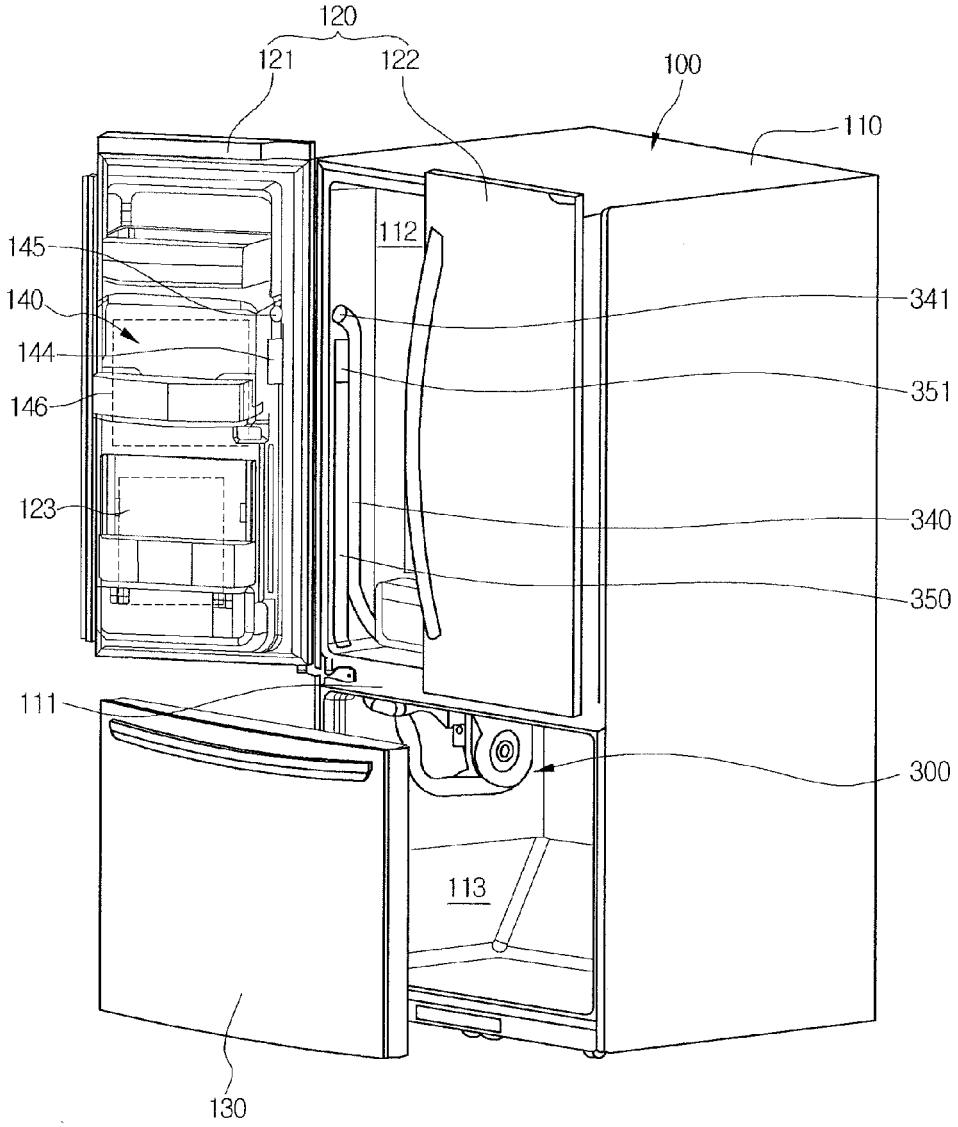
FIG. 3 is a perspective view of a refrigerator with a door opened.
Figure 4:
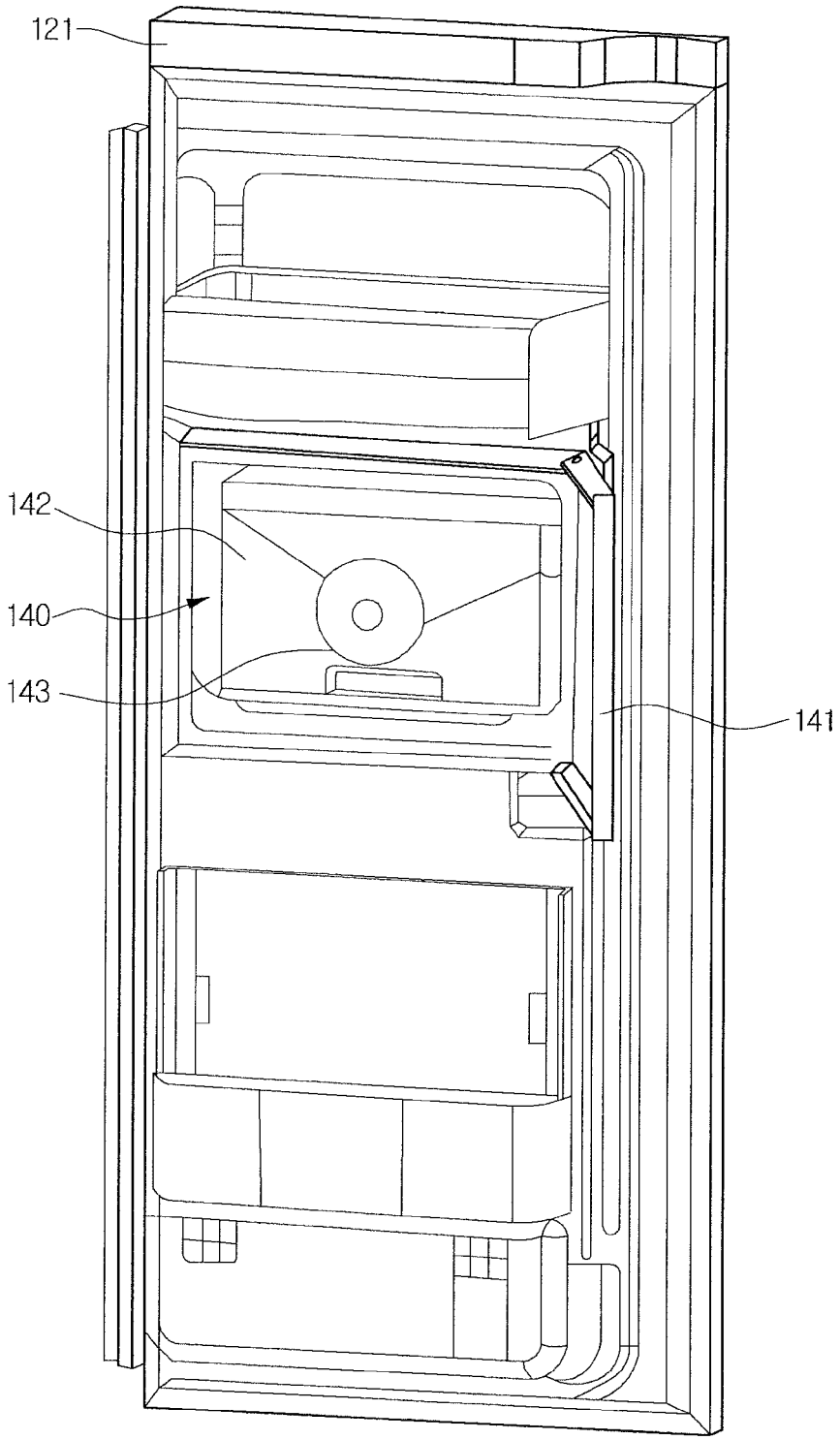
FIG. 4 is a perspective of an ice bank with a door opened.
Figure 5:
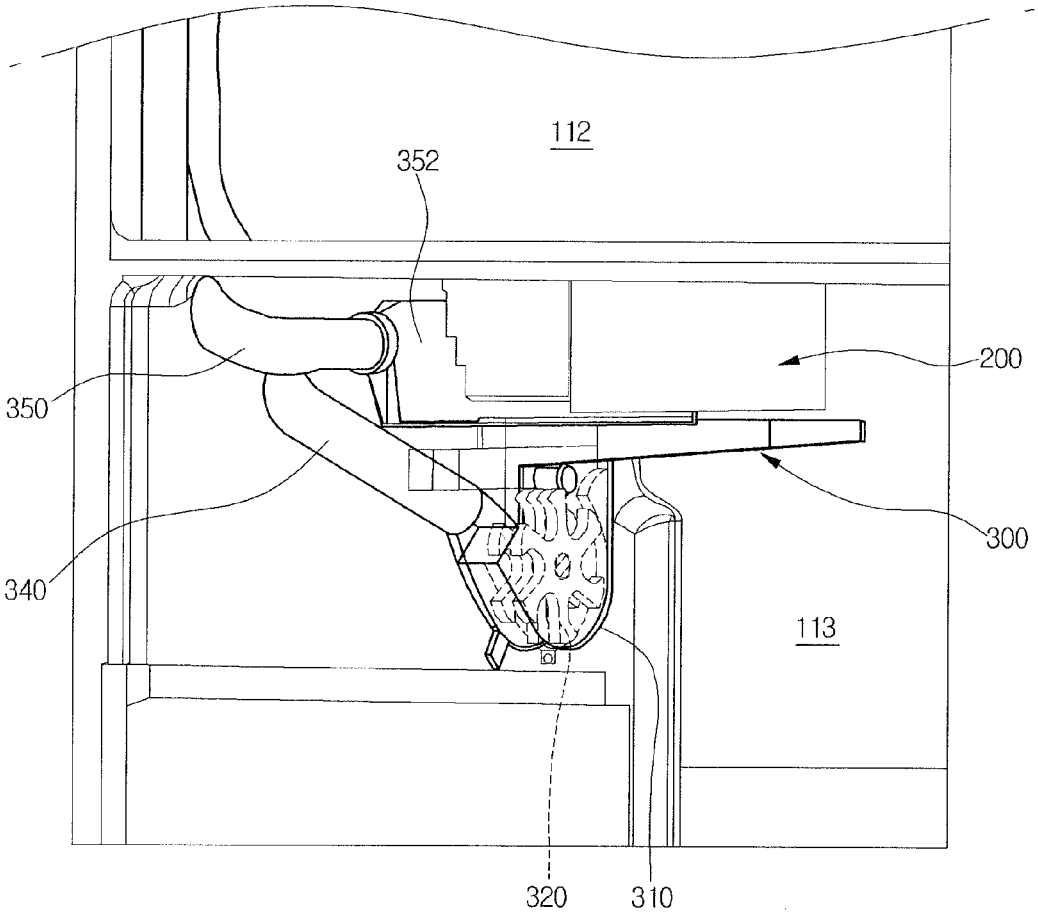
FIG. 5 is a partial perspective view illustrating the inside of a freezing compartment.

FIG. 3 illustrates an example refrigerator with a door opened. FIG. 4 illustrates an example ice bank with a door opened. FIG. 5 illustrates the inside of an example freezing compartment.

Referring to FIGS. 3 to 5, a refrigerator 100 includes a cabinet 110 and a door. Here, the cabinet 110 and the door define an outer appearance of the refrigerator 100. The inside of the cabinet 110 is partitioned by a barrier 111. That is, a refrigerating compartment 112 is defined at an upper side, and a freezing compartment 113 is defined at a lower side.

An ice maker 200 for making ice pieces and an ice transfer device 300 for transferring the made ice pieces into an ice bank 140 may be provided within the freezing compartment 113. An ice chute 340 constituting the ice transfer device 300 and openings 341 and 351 defined in ends of a cool air duct 350 are exposed to a sidewall of the refrigerating compartment 112.

In detail, the door includes a refrigerating compartment door 120 for covering the refrigerating compartment 112 and a freezing compartment door 130 for covering the freezing compartment 113. The refrigerating compartment door 120 includes a first refrigerating compartment door 121 and a second refrigerating compartment door 122 which are respectively disposed on left and right sides. The first and second refrigerating compartment doors 121 and 122 are independently rotated with respect to each other. Also, the first and second refrigerating compartment doors 121 and 122 may partially or wholly cover the refrigerating compartment 112. Also, the freezing compartment door 130 may be slidably withdrawn in front and rear directions to open or close the freezing compartment 113.

A dispenser 123 may be provided in a front surface of the first refrigerating compartment door 121. Water supplied from a water supply source and ice pieces made in the ice maker 200 (that will be described below in more detail) may be dispensed to the outside of the refrigerating compartment door 120 through the dispenser 123.

An ice bank 140 is provided at (e.g., in, on, etc.) a back surface of the first refrigerating compartment door 121. The ice bank 140 provides a space for storing ice pieces transferred by the ice transfer device that will be described below in more detail. The ice bank 140 provides a thermally insulative space. Also, the ice bank 140 is selectively opened or closed by an ice bank door 141. When the first refrigerating compartment door 121 is closed, the ice bank 140 is connected to the ice chute 340 and the cool air duct 350. Also, ice pieces may be supplied through the ice chute 340, and cool air may return into the freezing compartment 113 through the ice chute 340. Also, cool air may be supplied into the ice bank 140 by the cool air duct 350.

The ice bank 140 communicates with the dispenser 123. Thus, when the dispenser 123 is manipulated, ice pieces stored in the ice bank 140 may be dispensed. Also, a separate case 142 for receiving ice pieces may be provided within the ice bank 140. Also, an auger 143 configured to smoothly transfer ice pieces and a blade for crushing ice pieces prior to dispensing may be further provided within the ice bank 140.

The ice bank 140 protrudes from a back surface of the first refrigerating compartment door 121. Thus, when the first refrigerating compartment door 121 is closed, the ice bank 140 contacts an inner sidewall of the refrigerating compartment 112. An air hole 144 and an ice inlet hole 145 may be further defined in a sidewall of the ice bank 140 corresponding to the openings 341 and 351. Thus, when the first refrigerating compartment door 121 is closed, the made ice pieces and the cool air for maintaining the ice pieces may be supplied into the ice bank 140.

A withdrawable drawer, the ice maker 200, and the ice transfer device 300 may be disposed inside the freezing compartment 113.

The ice maker 200 is configured to make ice pieces using water supplied from the water supply source. The ice maker 200 may be disposed on an upper portion of a left side of the freezing compartment 113. The ice maker 200 is fixedly mounted on a bottom surface of the barrier 111. The ice pieces made in the ice maker 200 drop downward and then are temporarily received in an ice bin 310 disposed above the ice transfer device 300. The ice transfer device 300 and the ice bank 140 communicate with each other by the ice chute 340.

Here, the positions of the ice maker 200 and the ice transfer device 300 may be determined by the position of the ice bank 140. For example, if the ice bank 140 is disposed in the first refrigerating compartment door 121, the ice transfer device 300 may be disposed on an upper portion of a left side of the freezing compartment 113 so that a distance between the ice transfer device 300 and the ice bank 140 is minimized.

The transfer device 300 may be disposed under the ice maker 200 and fixed to a wall of a side of the freezing compartment 113. A transfer member 320 for transferring ice pieces may be disposed within the housing 310. The housing 310 is connected to the ice chute 340 to transfer made ice pieces into the ice bank 140 through the ice chute 340. A specific structure of the transfer device 300 will be described in more detail below.

The cool air duct 350 is disposed on a side of the transfer device 300. The cool air duct 350 is configured to supply the cool air within the freezing compartment into the ice bank 140. An entrance of the cool air duct is exposed to the inside of the freezing compartment 113. Also, a cool air supply part 352 including a blow fan may be further provided on the inlet port of the cool air duct 350. The cool air supply part 352 may communicate with an evaporation chamber.

Hereinafter, an example structure of the ice maker 200 will be described in more detail with reference to the accompanying drawings.

The ice maker 200 may be designed to make globular or spherical ice.

Figure 6:
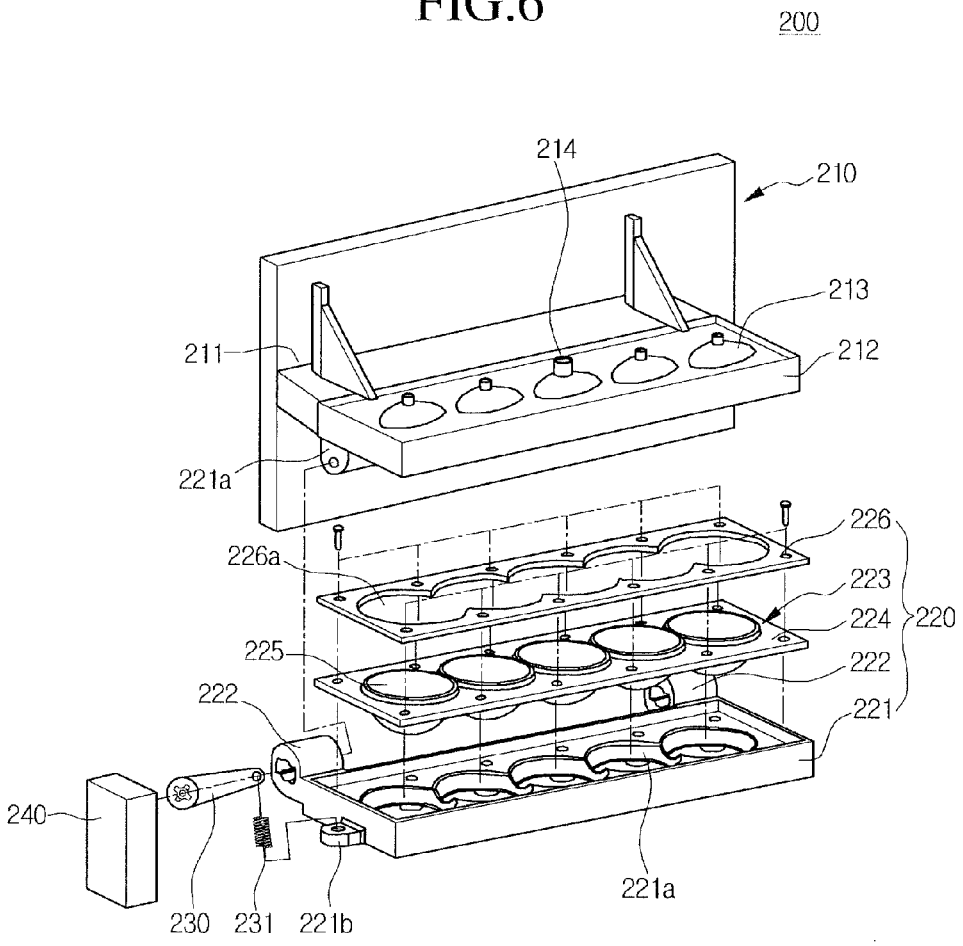
FIG. 6 is an exploded perspective view of an ice maker.

FIG. 6 illustrates an example ice maker.

Referring to FIG. 6, the ice maker 200 may be mounted on a bottom surface of the barrier 111. The ice maker 200 includes an upper tray 210 defining an upper appearance, a lower tray 220 defining a lower appearance, a motor assembly for operating one of the upper tray 210 and the lower tray 220, and an ejecting unit for separating ice pieces made on the upper or lower tray 210 or 220.

In detail, the lower tray 220 has a substantially square shape when viewed from an upper side. A recess part 225 recessed downward is defined inside the lower tray 220. A lower half of a globular or spherical ice piece is made in the recess part 225. The lower tray 220 may be formed of a metal material. As needed, a portion of the lower tray 220 may be formed of an elastic material. In some examples, the recess part 225 may be formed of an elastically deformable material.

The lower tray 220 includes a tray case 221, a tray body 223 seated on the tray case 221 and having the recess parts 225 arranged therein, and a tray cover 226 for fixing the tray body 223 to the tray case 221.

The tray case 221 may have a square frame shape. Also, the tray case 221 may further extend upward and downward along a circumference thereof. Also, a seat part **221*a* punched in a circular shape is disposed within the tray case 221. The seat part 221*a* may be closely attached to an outer surface of the recess part 225. In detail, the inner surface of the seat part 221*a* may be rounded so that the recess part 225 having a hemispherical shape may be stably and closely attached thereto. The seat part 221*a* may be provided in plurality to correspond to the position and shape of the recess part 225. Thus, the plurality of seat parts 221*a*** may be connected to each other.

An upper tray connection part 222 is disposed on each of both edges of a rear surface of the tray case 221. The upper tray 210 and the motor assembly 240 are coupled to the upper tray connection part 222. An elastic member 231 for providing an elastic force so that the lower tray 220 is closely attached to the upper tray 210 is connected to one side surface of the tray case 221. In detail, an elastic member mounting part **221*b* protrudes from a side surface of the tray case 221. An end of the elastic member 231 is connected to the elastic member mounting part 221*b***.

The whole tray body 223 or the recess part 225 may be formed of an elastically deformable flexible material. The tray body 223 is seated on a top surface of the tray case 221. The tray body 223 includes a plane part 224 and the recess part 225 recessed downward from the inside of the plane part 224.

The plane part 224 has a plate shape with a predetermined thickness. Also, the plane part 224 may have a shape to correspond to that of the top surface of the tray case 221 so that the plane part 224 is received into the tray case 221. Also, the recess part 225 may have the hemispherical shape. Alternatively, the recess part 225 may have a shape corresponding to that of a recess part 213 (that will be described in more detail below) of the upper tray 210. Thus, when the upper and lower trays 210 and 220 are closely attached to each other, the recess parts 225 and 213 may form a globular or spherical shell.

The recess part 225 may pass through the seat part 221*a* of the tray case 221 to protrude downward. Thus, the recess part 225 may be pushed by the ejecting unit when the lower tray 220 is rotated. As a result, an ice piece within the recess part 225 may be separated to the outside. Also, a lower protrusion protruding upward is disposed on a circumference of the recess part 225. When the upper tray 210 and the lower tray 220 are closely attached to each other, the lower protrusion may overlap with an upper protrusion of the upper tray 210 to reduce water leakage.

Also, the tray cover 226 is seated on a top surface of the tray body 223. Thus, the tray body 223 is fixed to the tray case 221. Also, a coupling member such as a screw or rivet successively passes through the tray cover 226, the tray body 223, and the tray case 221 to complete the lower tray 220.

A punched part 226*a* having a shape corresponding to that of an opened top surface of the recess part 225 is defined in the tray cover 226. The punched part 226*a* may have a shape in which a plurality of circular holes successively overlap with each other. Thus, when the lower tray 220 is completely assembled, the recess part 225 is exposed through the punched part 226*a*, and the lower protrusion is disposed inside the punched part 226*a*.

The upper tray 210 defines an upper appearance of the ice maker 200. The upper tray 210 may include a mounting part 211 for mounting the ice maker 200 and a tray part 212 for making ice pieces.

In detail, the mounting part 211 is configured to mount the ice maker 200 inside the freezing compartment 113. The mounting part 211 may extend in a vertical direction perpendicular to that of the tray part 212. Thus, the mounting part 211 may surface-contact a side surface of the freezing compartment 113 or a side surface of an ice maker case for receiving the ice maker 200.

Also, a plurality of recess parts 213 recessed in a hemispherical shape may be provided in the tray part 212. The recess parts 213 are successively arranged in a line. An upper half of a globular or spherical ice piece may be formed in each of the recess parts 213. When the upper tray 210 and the lower tray 220 are closely attached to each other, the recess part 225 of the lower tray 220 and the recess part 213 of the upper tray 210 are closely attached to each other to form a globular or spherical shell.

A shaft coupling part 211*a* to which the lower tray connection part 222 is shaft-coupled may be further disposed on a rear side of the tray part 212. The shaft coupling part 211*a* protrudes from both edges of a rear bottom surface of the tray part 212 and is shaft-coupled to the lower tray connection part 222. Thus, the lower tray 220 is rotatably connected to the upper tray 210. Also, the lower tray 220 is closely attached to the upper tray 210 or separated from the upper tray 210 while the lower tray 220 is rotated by the rotation of the motor assembly 240. Here, a state in which the lower tray 220 is closely attached to the upper tray 210 may be defined as a state in which the tray is closed. Also, a state in which the lower tray 220 is rotated and thus separated from the upper tray 210 may be defined as a state in which the tray is opened.

The upper tray 210 may be formed of a metal material. Thus, the upper tray 210 may be configured to quickly freeze water within the globular or spherical shell. Also, an ice separation heater for heating the upper tray 210 to separate ice pieces from the upper tray 210 may be further provided on the upper tray 210. The ice separation heater may have a U shape. Also, the ice separation heater may contact an outer surface of each of the recess parts 213.

Also, air holes 214 for supplying water and discharging air within the shell is defined in the recess parts 213 of the upper tray 210, respectively. One of the air holes 214 may serve as a water supply part through which water supplied from a water supply tray or a water supply tube passes. In some implementations, a middle air hole 214 serves as the water supply part. The middle air hole 214 serving as the water supply part may have a diameter or length greater than those of the other air holes.

Like the lower tray 220, the recess part 213 of the upper tray 210 may be formed of an elastic material. In this case, an ejecting pin for pressing a top surface of the recess part 213 instead of the ice separation heater may be provided above the upper tray.

A rotating arm 230 and the elastic member 231 are disposed on a side of the lower tray 220. The rotating arm 230 may be provided for the tension of the elastic member 231. The rotating arm 230 may be rotatably mounted on the lower tray 220.

The rotating arm 230 has one end shaft-coupled to the lower tray connection part 222 and the other end connected to the other end of the elastic member 231. The rotating arm 230 may be further rotated by a predetermined angle in a state where the lower tray 220 is closely attached to the upper tray 210 to expand the elastic member 231. Thus, the upper tray 220 may strongly press the upper tray 210 by a restoring force of the elastic member 231 to reduce water leakage.

The motor assembly 240 is disposed on a side of the upper and lower trays 210 and 220. A rotation shaft of the motor assembly 240 is connected to a rotation shaft passing through the upper tray connection part 222. Also, the motor assembly 240 may further include a deceleration gear in which a plurality of gears are combined with each other to adjust a rotation rate of the lower tray 220.

Figure 7:
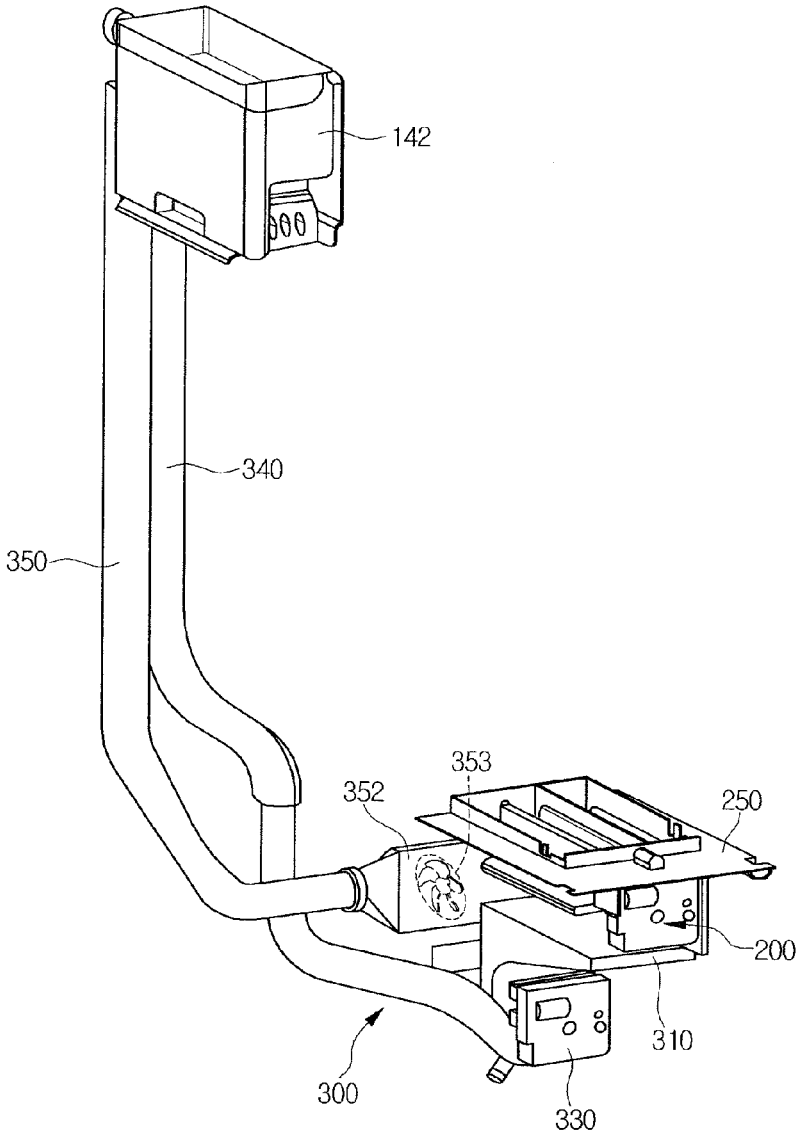
FIG. 7 is a perspective view of a transfer device.
Figure 8:
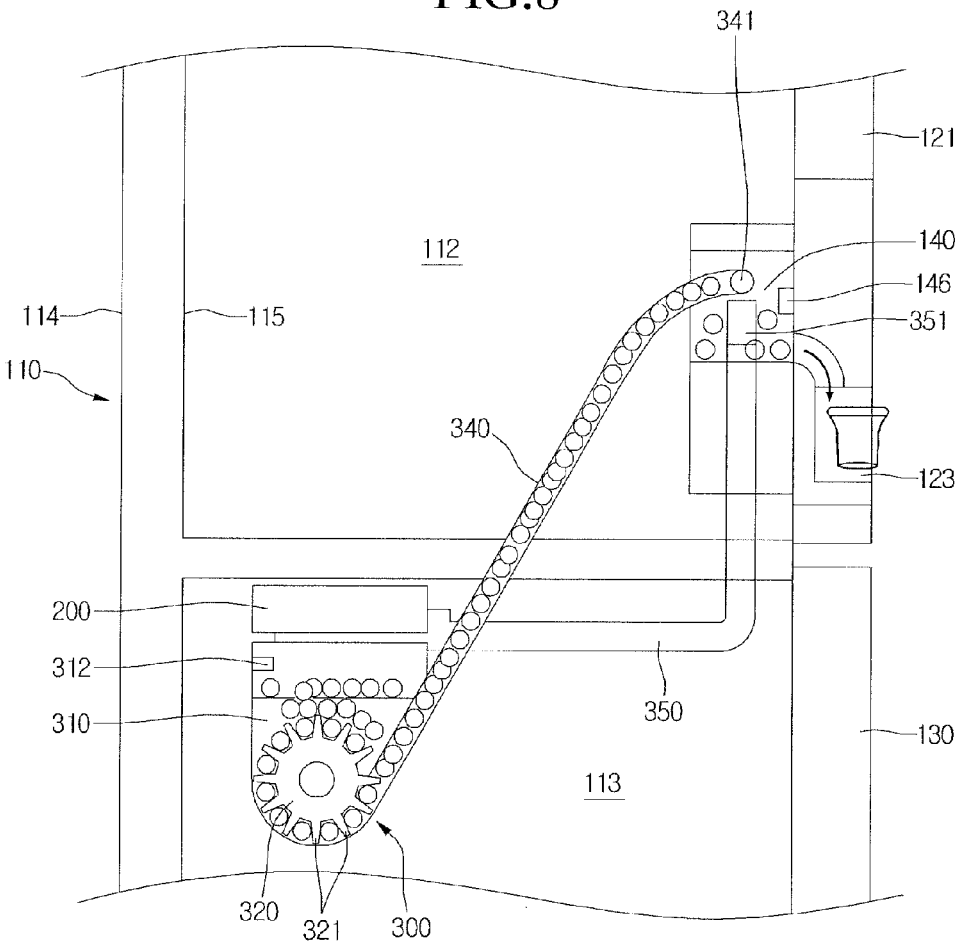
FIG. 8 is a schematic view illustrating an ice transfer state through the transfer device.

FIG. 7 illustrates an example transfer device. FIG. 8 illustrates an example ice transfer state through the example transfer device.

Referring to FIGS. 7 and 8, the transfer device 300 may be connected to the ice bank 140 and may be provided in the freezing compartment 113 to transfer ice pieces through the freezing compartment 113, the refrigerating compartment 112, and the first refrigerating compartment door 121. Thus, ice pieces made in the ice maker 200 may be supplied into the ice bank 140.

The transfer device 300 may be mounted within an inner case 115 defining an inner surface of the cabinet 110 and be exposed to the inside of the refrigerator. Here, the transfer device 300 may be mounted on a member such as a separate bracket coupled to the inner case 115. That is, the ice maker 200 may be mounted on a bracket 250 fixed to a bottom of the barrier 111. Also, the transfer device 300 may be fixed to the freezing compartment 113 by the bracket 250 at a lower side of the ice maker 200. Also, at least one portion of the transfer device 300 may be buried within an insulation material between an outer case 114 and the inner case 115 of the cabinet 110.

The transfer device 300 includes the housing 310 in which ice pieces transferred from the ice maker 200 are supplied, the transfer member 320 disposed within the housing 310 to transfer the ice pieces within the housing 310, a driving unit 330 for rotating the transfer member 320, and the ice chute 340 for guiding the ice pieces within the housing 310 up to the dispenser 123.

The housing 310 is disposed under the ice maker 200. Also, a space for receiving ice pieces and the transfer member 320 is defined within the housing 310. A top surface of the housing 310 is opened to allow ice pieces supplied from the ice maker 200 to drop therethrough.

In some examples, an upper portion of the housing 310 may be exposed to the inside of the freezing compartment 113. Also, a lower portion of the housing 310 in which the transfer member 320 is received may be buried within an insulation material between the outer case 114 and the inner case 115.

Also, the transfer member 320 is disposed within the housing 310. The transfer member 320 has a gear or impeller shape. The transfer member 320 may be configured to receive globular or spherical ice pieces into a space between a plurality of protrusions 321 disposed thereon.

In some implementations, the whole transfer member 320 may be received in the housing 310. A rotation shaft of the transfer member 320 passes though the housing 310 and is exposed to the outside of the housing 310. The driving unit 330 is connected to the rotation shaft of the transfer member 320 to provide a power for rotating the transfer member 320.

The driving unit 330 includes a driving motor for providing a rotation power and a gear assembly rotated by the driving motor. The gear assembly may be a deceleration gear in which a plurality of gears are combined with each other. A rotation rate of the transfer member 320 may be adjusted by the deceleration gear.

The ice chute 340 extends from a side of the housing 310 up to the first refrigerating compartment door 121 on which the ice bank 140 is mounted. Thus, the ice chute 340 may have a hollow tube shape so that ice pieces are transferred therethrough. For instance, the ice chute 340 may have an inner diameter corresponding to that of a globular or spherical ice or slightly greater than that of the globular or spherical ice. Thus, the made ice pieces may be successively transferred in a line.

The ice chute 340 may extend to pass through the barrier 111. Also, the ice chute 340 may be mounted so that the chute 340 is exposed to the outsides of the freezing compartment 113 and the refrigerating compartment 112. The insulation member may surround the exposed portion of the ice chute 340 to reduce (e.g., prevent) heat-exchange between the refrigerating compartment 112 and the ice chute 340.

The ice chute 340 may be disposed between the outer case 114 and the inner case 115. That is, the ice chute 340 may be disposed within a sidewall of the cabinet 110 corresponding to the first refrigerating compartment door 121. Here, the ice chute 340 may be thermally insulated by the insulation material within the cabinet 110 and not be exposed to the inside of the refrigerator.

The ice chute 340 may extend up to a side surface of the refrigerating compartment 112 corresponding to a side surface of the ice bank 140 in a state where the first refrigerating compartment door 121 is closed. An opening 341 located at an inner wall of the refrigerating compartment 112 is defined in an upper end of the ice chute 340. Thus, when the first refrigerating compartment door 121 is closed, the ice bank 140 and the ice chute 340 may communicate with each other. Thus, ice pieces may be moved along the ice chute 340 by the rotation of the transfer member 320 and supplied into the ice bank 140.

The cool air duct 350 is disposed along the refrigerating compartment 112 at a side of the freezing compartment 113. Also, the cool air duct 350 may be buried within the cabinet 100, like the ice chute 340. The cool air duct 350 communicates with the ice bank 140 in the state where the first refrigerating compartment door 121 is closed to supply cool air within the freezing compartment 113 into the ice bank 140. Thus, the cool air supplied into the cool air duct 350 cools the inside of the ice bank 140. Then, the cool air may return into the freezing compartment 113 through the ice chute 340 to realize the circulation of the cool air.

Hereinafter, an example operation of the example refrigerator including the above-described components will be described with reference to the accompanying drawings.

When the refrigerator 1 is operated, cool air generated in the evaporator may be supplied into the ice maker 200 provided inside the freezing compartment 113. A globular or spherical ice may be made in the ice maker 200 using water supplied into the ice maker 200. When the ice is completely made, the ice drops down by a heater provided in the ice maker 200 or an ice separation unit including an ejecting pin. Then, the ice pieces dropping from the ice maker 200 are stored in the housing 310. The ice pieces stored in the housing 310 are transferred into the ice chute 340 by the transfer member 320.

In detail, the plurality of protrusions 321 are disposed on the transfer member 320. A space in which the globular or spherical ice pieces are received one by one is defined between the protrusions 321. Thus, ice pieces introduced into the housing 310 are received into spaces between the plurality of protrusions 321 disposed on the transfer member 320 by the rotation of the transfer member 320.

The ice pieces received in the spaces defined in the transfer member 320 may be transferred by the rotation of the transfer member 320. Thus, the made ice pieces may be filled in the ice chute 340. Here, the transfer member 320 may be rotated to push the ice pieces within the ice chute 340, thereby discharging the ice pieces into the ice bank 140.

The ice pieces discharged into the ice bank 140 are stored in the ice bank 140. The ice pieces stored in the ice bank 140 may be dispensed through the dispenser 123 when the dispenser 123 is manipulated.

Also, a full ice detection device 146 may be provided in the ice bank 140. Also, a full ice detection device 312 may be disposed within the housing 310. A set amount or more of ice pieces may be filled into the ice bank 140 and the housing 310 by the full ice detection device pieces 146 and 312. Also, the operation of the ice maker 200 may be controlled by the full ice detection device pieces 146 and 312 until the set amount or more of ice pieces are fully filled. In this state, the transfer member 320 may be operated to supply the ice pieces into the ice bank 140.

When a user manipulates the dispenser 123 in a state where the ice bank 140 is fully filled with ice pieces, the operation of the driving unit 330 starts. When the transfer member 320 is rotated, an ice piece received in the space defined in the transfer member 320 may be rotated together to push an ice piece received in a lower end of the ice chute 340 upward. When the ice piece received in the lower end of the ice chute 340 is pushed upward, ice pieces successively staked within the ice chute 340 may be pushed at the same time to ascend upward. Also, globular or spherical ice pieces may be supplied into the ice bank 140 through the opening 341 of the ice chute 340. Then, the ice pieces may be dispensed to the outside through the dispenser 123.

Here, since the globular or spherical ice pieces are dispensed through the dispenser 123, the user may dispense a desired number of ice pieces by manipulating the dispenser 123.

The operation of the driving unit 330 may be restricted by a door sensor for detecting an opening/closing of the refrigerating compartment door 120. That is, when the user manipulates the dispenser 123 in a state where the refrigerating compartment door 120 is opened, the driving unit 330 may not be operated to prevent ice pieces from being dispensed. In addition, the operation of the driving unit 330 may be stopped just when the opening of the refrigerating compartment door 120 is detected. Thus, when the door is opened, the transfer of the ice pieces into the ice bank 140 may be stopped. As a result, the possibility of ice pieces dropping to the outside of the refrigerator due to the opening of the door when the ice pieces are transferred may be reduced.

A predetermined amount of ice pieces may be received in the housing 310. Thus, the globular or spherical ice pieces may be continuously transferred by the rotation of the transfer member 320. That is, ice pieces corresponding to the number of dispensed ice pieces may be supplied into the ice chute 340 to maintain a state in which the ice chute 340 is fully filled with ice.

Ice pieces may adhere to each other within the housing 310 or the ice chute 340, or ice pieces may not be smoothly transferred due to foreign substances. In this state, when the transfer member 320 is rotated, a load above a set load may be applied. Thus, when the load above the set load is detected in the driving unit 330, the motor of the driving unit 330 may be reversely rotated.

When the driving unit 330 is reversely rotated, the transfer member 320 may be reversely rotated. Thus, ice pieces received in the space of the transfer member 320 are moved into the housing 310. Also, ice pieces within the ice chute 340 may be moved downward by their own weight. Then, the ice pieces may be moved downward along the inclined ice chute 340. The ice pieces moved downward may be received in the space of the transfer member 320 which is reversely rotated, and then the ice pieces may be continuously moved into the housing 310.

Here, the driving unit 330 may be reversely rotated for a preset time to completely empty the inside of the ice chute 340. In this state, the driving unit 330 may be normally rotated to successively supply the ice pieces received in the space of the transfer member 320 into the ice chute 340. Then, a process for transferring ice pieces may be prepared.

Other implementations of the techniques described above may be applied to refrigerators. Hereinafter, another example refrigerator will be described.

If abnormal conditions occur when ice pieces are transferred, the ice pieces may be forcibly discharged into an ice bank disposed in a door by a discharge unit disposed in an ice chute to address the abnormal conditions. Here, a refrigerating compartment door is in a closed state.

Thus, since components are equal to those described above except for a transfer device, detailed descriptions will be referenced, rather than repeated, and the same reference numeral may be regarded as included in the description.

Figure 9:
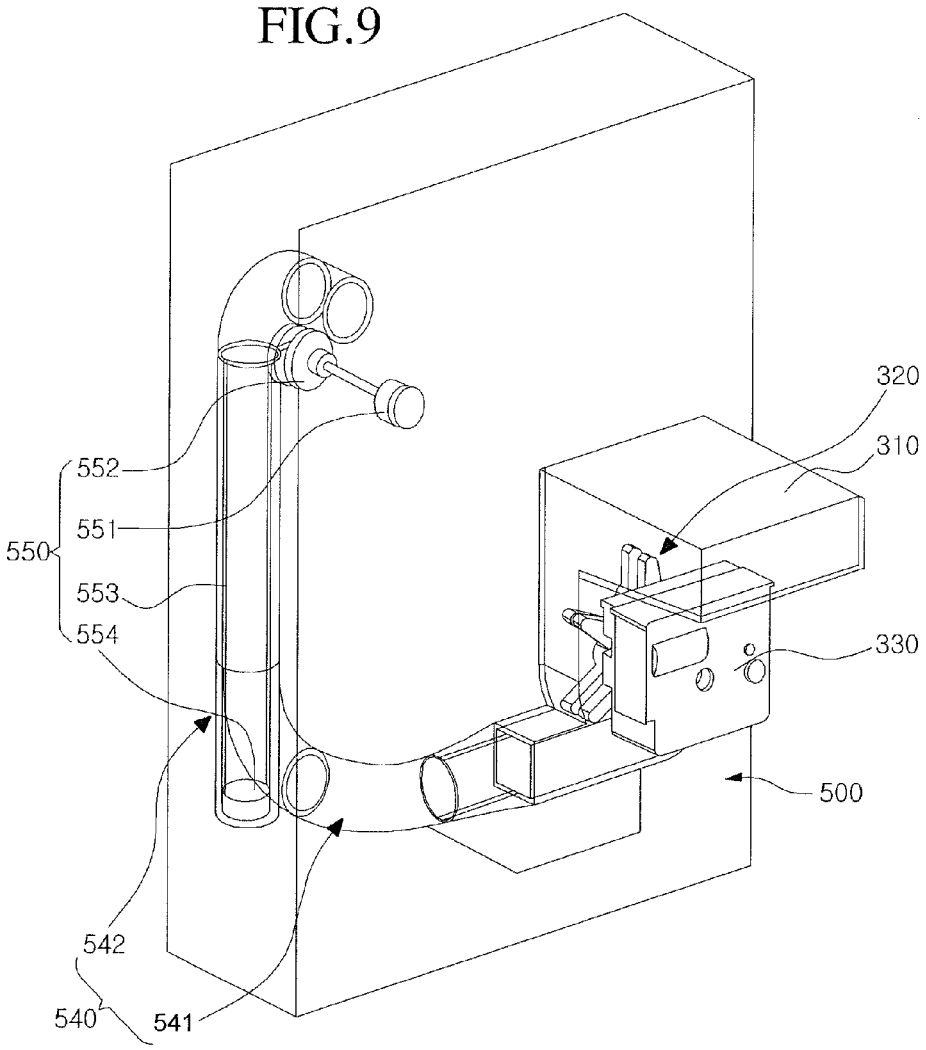
FIG. 9 is a perspective view of a transfer device.
Figure 10:
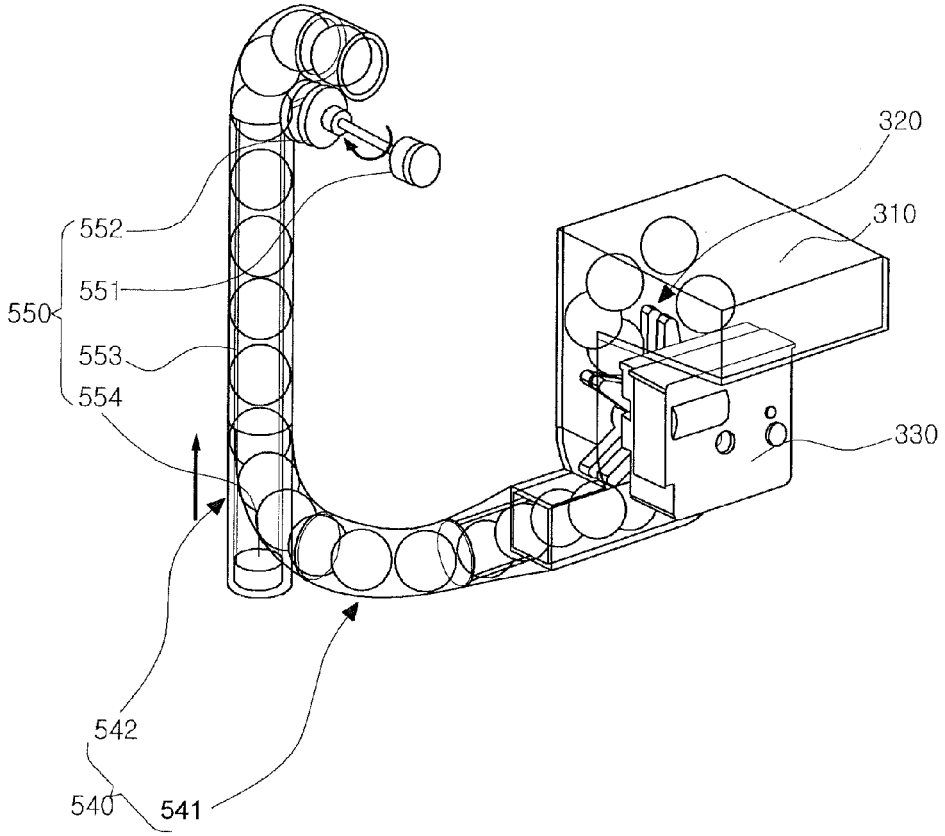
FIGS. 10 and 11 are views illustrating an operation of the transfer device.
Figure 11:
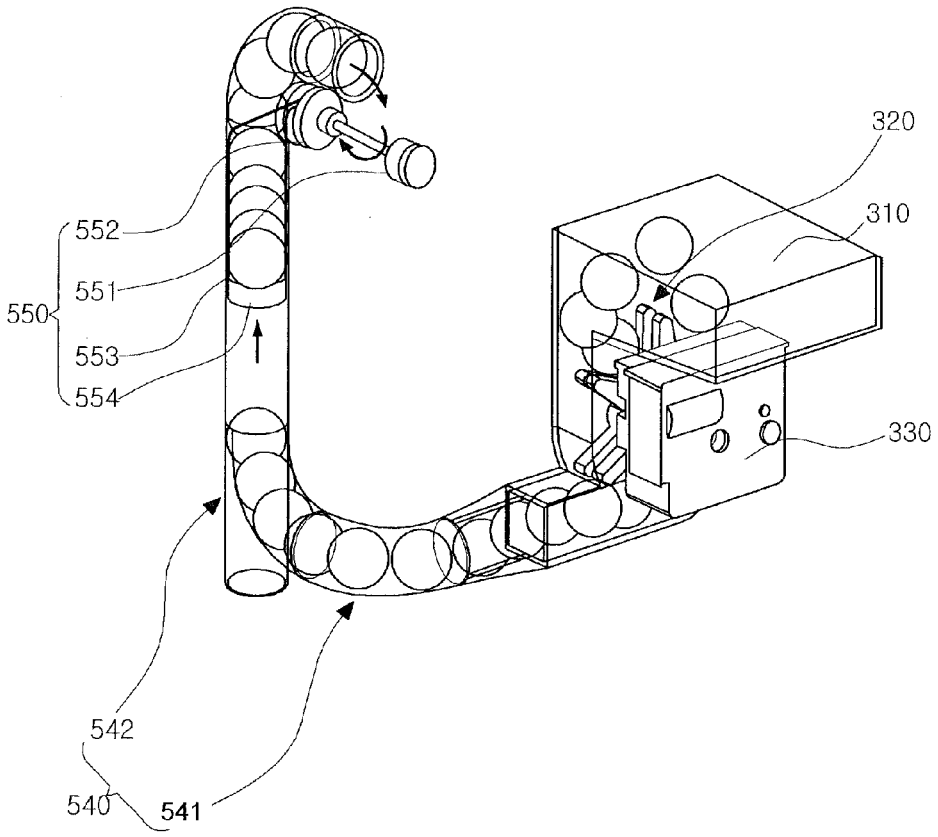

FIG. 9 illustrates an example transfer device. FIGS. 10 and 11 illustrate an example operation of the example transfer device.

Referring to FIGS. 9 to 11, a transfer device 500 includes a housing in which made ice pieces are received, a transfer member 320 disposed within the housing 310 to transfer made ice pieces, a driving unit 330 for operating the transfer member 320, an ice chute 540 for supplying the ice pieces within the housing 310 into an ice bank 140, and a discharge unit 550 for forcibly discharging the ice pieces within the ice chute 540 when abnormal conditions occurs. Here, other components except for the ice chute 540 and the discharge unit 550 may be equal to those described above.

In detail, the ice chute 540 may have a pipe shape to move globular or spherical ice pieces one by one. The ice chute 540 includes a first chute 541 extending from a side of the housing 310 and a second chute 542 connected to the first chute 541 and extending toward a first refrigerating compartment door 121 on which the ice bank 140 is mounted.

The first chute 541 may be disposed within a freezing compartment 113. Also, the first chute 541 may extend forward from a side of the housing 310 and then be bent with a predetermined curvature. A front end of the first chute 541 (e.g., an outlet end) may communicate with the second chute 542 so that ice pieces are moved into the second chute 542 by passing through the first chute 541.

The second chute 542 is buried into an insulation material within a cabinet 110 and lengthily extends in a vertical direction. That is, the second chute 542 may extend from a position corresponding to that of the outlet end of the first chute 541 up to a height of the ice bank 140. An upper end of the second chute 542 may be opened to the inside of the refrigerating compartment 112. Also, the upper end of the second chute 542 communicates with the first refrigerating compartment door 121 to supply ice pieces into the ice bank 140. A lower end of the second chute 542 further extends downward from the outlet end of the first chute 541. That is, the outlet end of the first chute 541 is connected to the second chute 542 at a position spaced a predetermined height upward from the lower end of the second chute 542. Also, a dispensing member 554 that is part of the discharge unit 550 is received in the inside of the lower end of the second chute 542.

In detail, the discharge unit 550 is a unit for forcibly moving ice pieces when abnormal conditions occur. The discharge unit 550 is disposed inside the second chute 542. The discharge unit 550 includes a driving member 551 disposed on an upper portion of the second chute 542, a reel member 552 rotated by the driving member 551, and a wire member 553 wound around the reel member 552 to lift the dispensing member 554.

In detail, the driving member 551 may include an electric motor to provide a rotation power. Also, a rotation shaft of the driving member 551 is connected to a rotation shaft of the reel member 552 to rotate the reel member 552. The wire member 553 has one end connected to a side of the reel member 552 and the other end passing through the inside of the second chute 542. The other end of the wire member 553 passes from a top surface to a bottom surface of the dispensing member 554 and then passes from the bottom surface to the top surface, thereby being fixed to a certain position of the second chute 542. The position to which the wire member 553 is fixed may be a height approaching the reel member 552. According to the above-described structure, when the reel member 552 is rotated, the wire member 553 is wound around the reel member 552, and thus the dispensing member 554 is moved upward.

In a normal operation condition, the dispensing member 554 is disposed at the lower end of the second chute 542 to inhibit made ice pieces passing along the first and second chutes 541 and 542 from interfering with the first and second chutes 541 and 542. Thus, in normal operation conditions, ice pieces may be fully filled into the ice chute 540 as shown in FIG. 10. Also, when the driving unit 330 is operated by manipulation of a user, the transfer member 320 is rotated to supply the made ice pieces into the housing 310. Then, the ice pieces within the ice chute 540 may be pushed and supplied into the ice bank 140.

On the other hand, when the ice pieces within the ice chute 540 adhere to each other or are not dispensed due to other effects in the state where the ice pieces are fully filled into the ice chute 540, an abnormal condition in which the transfer member 320 is not rotated may occur. In this case, a load above a preset value occurs in the driving unit 330. Thus, when the load above the preset value occurs, a control part determines that the abnormal condition occurs.

When the abnormal condition occurs, the ice maker 200 stops the separation of the ice pieces and also the operation of the driving unit 330. In this state, the driving member 551 is operated to rotate the reel member 552. As the reel member 552 is rotated, the wire member 553 is wound around the reel member 552. Thus, as the wire member 553 is wound, the dispensing member 554 is moved upward. When the dispensing member 554 is moved upward, the ice pieces received in the second chute 542 are forcibly moved upward to discharge the ice pieces into the ice bank 140 as shown in FIG. 11.

A device for generating vibration in the ice chute 540 to more smoothly discharge ice pieces or a heater for heating ice pieces to smoothly transfer the ice pieces may be further provided.

When the dispensing member 554 is completely moved upward, the discharge of the ice pieces received in the second chute 543 is completed. Then, the driving member 551 is reversely rotated again, and also the reel member 552 is reversely rotated again.

As the reel member 552 is rotated, the wire member 553 is released, and thus, the dispensing member 554 is moved downward. As a result, the dispensing member 554 may be disposed at the lowermost end of the second chute 542.

According to some implementations, since the ice maker is disposed in the freezing compartment, it may be unnecessary to secure a separate space for receiving the ice maker in the refrigerating compartment door. Thus, a space for storing may be expanded in the back surface of the refrigerating compartment door while maintaining the dispensing convenience of ice pieces. Thus, the storage capacity of the refrigerator may be expanded on the whole while maintaining convenience of use.

Also, since ice pieces are made in the freezing compartment, it may be unnecessary to continuously supply cool air sufficient for making ice pieces into the refrigerating compartment door. Thus, cooling efficiency may be improved, and the power consumption may be reduced. Also, since ice pieces are made in the freezing compartment, ice making efficiency also may be improved.

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses also will be apparent to those skilled in the art.

What is claimed is:

1. A refrigerator comprising:

a cabinet comprising a refrigerating compartment and a freezing compartment;

a refrigerating compartment door configured to open and close at least a portion of the refrigerating compartment;

a dispenser disposed at the refrigerating compartment door and configured to dispense ice pieces;

an ice bank that is disposed at the refrigerating compartment door, that defines an insulation space for storing the ice pieces, and that is configured to supply the ice pieces to the dispenser;

an ice maker disposed in the freezing compartment and configured to make the ice pieces;

a transfer device disposed in the freezing compartment and configured to transfer the ice pieces made by the ice maker to the ice bank;

an ice chute that connects the transfer device to the ice bank and that is configured to guide the ice pieces transferred by the transfer device to the ice bank, the ice chute including:

a first chute extending from the transfer device; and a second chute connected to an end of the first chute and extending along a wall of the refrigerating compartment; and a discharge member provided inside the second chute and configured to move up and down to lift ice pieces in the second chute toward the ice bank, wherein the ice maker comprises:

an upper tray having a plurality of first recess parts, each having a hemispherical shape;

a lower tray rotatably coupled to the upper tray, a rotational axis of the lower tray being disposed at a first side edge of the lower tray, the lower tray having a plurality of second recess parts, each having a shape corresponding to that of each of the first recess parts;

a rotating arm of which a first end is coupled to the lower tray, wherein the rotational axis of the lower tray passes through the first end of the rotating arm and is perpendicular to the rotating arm;

an elastic member connecting a second end of the rotating arm and the lower tray, the second end of the rotating arm being opposite of the first end of the rotating arm, wherein a first end of the elastic member is coupled to the second end of the rotating arm and a second end of the elastic member is coupled to a mounting part located at a second side edge of the lower tray, wherein the second side edge of the lower tray is perpendicular to the first side edge of the lower tray, and the mounting part is a predetermined distance away from the rotational axis of the lower tray; and a motor assembly of which a rotating shaft passes through the first end of the rotating arm to rotate the rotating arm, wherein, based on the rotating shaft of the motor assembly rotating in a first direction, the rotating arm integrally rotates with the rotating shaft of the motor assembly in the first direction to expand the elastic member, and the lower tray is rotated by a restoring force of the elastic member in the first direction to be attached to a lower surface of the upper tray, and wherein, based on the rotating shaft of the motor assembly rotating in a second direction which is opposite to the first direction, the rotating arm integrally rotates with the rotating shaft of the motor assembly in the second direction, and the lower tray is rotated in the second direction to be separated from the upper tray.

2. The refrigerator according to claim 1, wherein the transfer device comprises:

a housing configured to store the ice pieces made by the ice maker;

a transfer member rotatably mounted inside the housing and configured to transfer the ice pieces within the housing; and a driving motor connected to a rotation shaft of the transfer member and configured to rotate the transfer member.

3. The refrigerator according to claim 2, wherein the transfer member comprises a plurality of impellers extending in a radial direction, and the ice pieces are received into spaces defined by adjacent impellers.

4. The refrigerator according to claim 2, further comprising a deceleration gear connected to a rotation shaft of the driving motor and configured to control a rotation rate of the transfer member.

5. The refrigerator according to claim 1, wherein the lower tray is configured to cause the first and second recess parts to attach to each other to define a spherical shell.

6. The refrigerator according to claim 1, wherein the ice chute extends along sidewalls of the freezing compartment and the refrigerating compartment, in a state where the refrigerating compartment door is closed, an outlet end of the ice chute communicates with the ice bank, and in a state where the refrigerating compartment door is open, the outlet end of the ice chute is disconnected from the ice bank.

7. The refrigerator according to claim 1, further comprising a cool air duct that extends along sidewalls of the freezing compartment and the refrigerating compartment and that connects the freezing compartment to the ice bank.

8. The refrigerator according to claim 7, wherein an inlet end of the cool air duct communicates with the freezing compartment or an evaporation chamber, an outlet end of the cool air duct communicates with the ice bank in a state where the refrigerating compartment door is closed, and the outlet end of the cool air duct is disconnected from the ice bank in a state where the refrigerating compartment door is open.

9. The refrigerator according to claim 7, further comprising a blow fan provided on an inlet-side of the cool air duct.

10. The refrigerator according to claim 2, further comprising a full ice detection device mounted on at least one of the ice bank and the housing.

11. The refrigerator according to claim 1, further comprising a vibration generation device configured to transmit vibration to the ice chute to reduce a likelihood of ice pieces within the ice chute adhering to each other.

12. The refrigerator according to claim 1, wherein the end of the first chute is connected to a position of the second chute that is spaced upward from a lower end of the second chute.

13. The refrigerator according to claim 1, further comprising:

a driving member configured to provide a rotation power;

a rotatable reel member connected to the driving member; and a wire member having a first end connected to the reel member and a second end connected to a position of the second chute by passing through the discharge member.

14. The refrigerator according to claim 13, wherein the wire member is wound around the reel member when the reel member is rotated to lift the discharge member upward through the second chute, thereby pushing the ice pieces within the second chute toward the ice bank.

15. The refrigerator according to claim 1, wherein the ice chute returns cool air supplied into the ice bank to the freezing compartment.

16. The refrigerator according to claim 1, further comprising a door sensor configured to detect opening or closing of the refrigerating compartment door, wherein an operation of the transfer device is restricted according to the opening or closing of the door detected by the door sensor.

17. The refrigerator according to claim 16, wherein the transfer device is disabled based on the door sensor detecting opening of the refrigerating compartment door.

18. The refrigerator according to claim 1:

wherein the dispenser is disposed in the refrigerating compartment door; and wherein the ice bank disposed in the refrigerating compartment door.

* * * * *